US006306148B1

(12) United States Patent
Knesch et al.

(10) Patent No.: US 6,306,148 B1
(45) Date of Patent: Oct. 23, 2001

(54) EPILATION DEVICE

(75) Inventors: Holger Knesch, Ludwigsburg; Pedro Sanchez-Martinez, Kronberg, both of (DE)

(73) Assignee: Braun GmbH, Frankfurt (DE)

( * ) Notice: Subject to any disclaimer, the term of this patent is extended or adjusted under 35 U.S.C. 154(b) by 0 days.

(21) Appl. No.: 09/508,022

(22) PCT Filed: Jun. 18, 1998

(86) PCT No.: PCT/EP98/03729

§ 371 Date: Mar. 6, 2000

§ 102(e) Date: Mar. 6, 2000

(87) PCT Pub. No.: WO99/20147

PCT Pub. Date: Apr. 29, 1999

(30) Foreign Application Priority Data

Oct. 17, 1997 (DE) ..... 197 45 877
Jan. 28, 1998 (DE) ..... 198 02 996

(51) Int. Cl.[7] ..... A61B 17/50
(52) U.S. Cl. ..... 606/133
(58) Field of Search ..... 606/133, 210, 606/211, 36, 43

(56) References Cited

U.S. PATENT DOCUMENTS 5,041,123 * 8/1991 Oliveau et al. ..... 606/133
5,234,442 * 8/1993 Schafer et al. ..... 606/133
5,356,415 * 10/1994 Iwasaki et al. ..... 606/133
5,507,753 * 4/1996 Iwasaki et al. ..... 606/133
5,810,843 * 9/1998 Iwasaki et al. ..... 606/133

FOREIGN PATENT DOCUMENTS 0 547 390 6/1993 (EP) .
0 569 614 11/1993 (EP) .
0 622 033 11/1994 (EP) .
2 668 902 5/1992 (FR) .

* cited by examiner

*Primary Examiner*—Gene Mancene
*Assistant Examiner*—Eduardo C. Robert
(74) *Attorney, Agent, or Firm*—Fish & Richardson P.C.

(57) ABSTRACT

An epilation appliance for the removal of hairs from the skin of a human body includes a rotary cylinder equipped with clamping elements operable to execute a closing movement within a zone of the rotary movement of the rotary cylinder. A mechanism of the epilation device is pivotable for adjusting the zone of the closing movement in dependence upon the angle at which the epilation appliance is placed against the skin, with the pivot axis being disposed in offset relation to the axis of rotation.

34 Claims, 8 Drawing Sheets

EPILATION DEVICE

BACKGROUND OF THE INVENTION

This invention relates to an epilation appliance for the removal of hairs from the skin of a human body, comprising a rotary cylinder equipped with clamping elements operable to execute a closing movement within a zone of the rotary movement of the rotary cylinder, with means being provided which are pivotal about a pivot axis for adjusting the zone of the closing movement in dependence upon the angle at which the epilation appliance is placed against the skin.

An epilation appliance of this type is known from patent application FR 2 668 902 A1.

This printed specification discloses an epilation appliance in which means are provided for adjusting the zone of the closing movement in dependence upon the angle at which the epilation appliance is placed against the skin. The purpose of this is to enhance the effectiveness of the appliance by correcting the closing instant of the clamping elements to a preferred value automatically in dependence upon the angle defined between the epilation appliance and the skin. Said means include a frame which is pivotally mounted about the axis of rotation of the rotary cylinder. Provided approximately in the middle of the rotary cylinder between the frame's two longitudinal sides is a U-shaped yoke extending across the rotary cylinder. By this means it is possible to adjust the zone of the closing movement in dependence upon the angle at which the epilation appliance is placed in contact with the skin. In practice, however, it has shown to be a disadvantage that this frame, including the U-shaped yoke arranged thereon, does not readily follow the tilting movements of the appliance nor the curved contours of the skin. In particular rapid tilting movements or irregularities of the skin surface cause the frame, together with the U-shaped yoke, to stick or tilt out of position in which case the longitudinal side of the U-shaped yoke is no longer in contact with the skin, hence making it impossible for the angle at which the epilation appliance is placed against the skin to be detected. Incidentally, the U-shaped yoke which extends over the outer circumference of the rotary cylinder prevents the rotary cylinder, that is, the clamping elements disposed in the rotary cylinder, from engaging the user's skin. In the mid-area of the prior art rotary cylinder a spaced relation is thus always maintained between the skin surface and the outer circumference of the rotary cylinder, that is, the clamping elements, rendering it difficult to catch the hairs and making it impossible where short hairs are involved.

By contrast, it is an object of the present invention to improve upon an epilation appliance of the type referred to in the foregoing to the effect that a reliable detection of the angle at which the epilation appliance is placed against the skin is accomplished, a secondary aspect of the invention being that the efficiency and effectiveness of epilation is not adversely affected by the means for detecting the angle and adjusting the zone of the closing movement compared with conventional appliances.

SUMMARY OF THE INVENTION

According to the present invention, this object is accomplished in an epilation appliance of the type initially referred to in that the pivot axis of the pivotal means is disposed in offset relation to the axis of rotation of the rotary cylinder and, preferably, above the axis of rotation.

This approach has the advantage that the means for adjusting the zone of the closing movement and for detecting the angle at which the epilation appliance is placed against the skin readily engage the skin surface and follow the contours of the skin with ease. This constructional arrangement largely avoids, for example, a one-sided disengagement of said means from the skin and the attendant incorrect angle detection. Said means are also in a position to respond readily to any rapid angular variations of the epilation appliance resulting from the user's individual manipulations. Also under adverse conditions this arrangement makes sure that the angle at which the epilation appliance is placed against the skin is detected with accuracy at all times and that, accordingly, the zone of the closing movement is also adjusted correspondingly and correctly in dependence upon this angle, thereby providing an extremely effective epilation appliance.

In an advantageous aspect of the present invention, a sensing means is provided by means of which the angle at which the epilation appliance is placed against the skin is detectable, said sensing means being pivotal about a pivot axis disposed approximately parallel to the axis of rotation of the rotary cylinder.

The sensing means is thus operable to detect automatically the angle at which the user places the epilation appliance in contact with the skin. Being pivotal about a pivot axis, the sensing means is capable of following any possible variations of said angle readily. Thus the angle at which the epilation appliance is placed against the skin is detected automatically at any instant of time and may be utilized for influencing, that is, modifying, the closing movement of the clamping elements.

In an advantageous further aspect of the present invention, the sensing means spans an engaging surface by means of which the epilation appliance may be placed in contact with the skin.

The engaging surface facilitates operation of the epilation appliance, requiring the user only to place the epilation appliance in contact with the skin with this engaging surface in order for the angle between the epilation appliance and the skin to be detectable.

Particularly advantageously, provision is made either for the pivot axis to be arranged on the side of the engaging surface close to the axis of rotation of the rotary cylinder at a small relative distance to the engaging surface, or for the pivot axis to be arranged on the side of the engaging surface facing away from the axis of rotation of the rotary cylinder, with the possibility for the pivot axis to lie also in the engaging surface. The position of the pivot axis is determined by the engaging surface making contact with the skin readily, also in cases where the epilation appliance is not placed vertically on the skin. In addition, the position of the pivot axis is also determined by the design effort considered to be still acceptable.

In either event, it is accomplished that the sensing means always makes full contact with the skin as the epilation appliance is moved across the skin. In particular skin irregularities will not cause the sensing means to stick or even tilt out of place. It is thereby ensured that the sensing means automatically and correctly detects the angle at which the user places the epilation appliance against the skin at any instant of time, including under conditions when the epilation appliance is moved across the skin.

In an advantageous further feature the sensing means includes two bars, rollers, hair lifting combs, housing edges or a combination of such means or the like, which span between them the engaging surface, said means being arranged approximately parallel to each other and approximately parallel to the axis of rotation of the rotary cylinder.

This represents a particularly simple design implementation of the sensing means. In this arrangement the engaging surface is advantageously spanned by the two bars. Interpositioned between the bars is the rotary cylinder with the clamping elements. The user positions the epilation appliance against the skin with the two bars. This ensures that the complete engaging surface makes contact with the skin. The zone within which closing of the clamping elements is effected is adjusted via the engaging surface. In operation the clamping elements revolving in the space between the bars may then catch and extract the hairs on the skin without further difficulty.

Particularly advantageously, the sensing means includes at least one side member which is pivotally connected to a pin forming the pivot axis or similar bearing structure and which supports the two bars or the like.

For one purpose, the side member(s) represent(s) simple design possibilities regarding the pivotal mounting of the sensing means' two bars spanning between them the engaging surface. For another purpose, the side member also serves for automatic detection and transmission, via the pivoted position of the bars, of the angle at which the engaging surface and hence the epilation appliance is placed against the skin.

In an advantageous embodiment of the present invention, an actuating means is provided by means of which the closing movement of the clamping elements can be produced within the predetermined zone, said actuating means being pivotal about the axis of rotation of the rotary cylinder in dependence upon the angle at which the epilation appliance is placed against the skin.

The actuating means serves the function of producing the closing movement of the clamping elements. This closing movement takes place in a predetermined zone as the rotary cylinder rotates. Hence the clamping elements execute the closing movement within a predetermined angular range of the rotary cylinder. This angular range is variable by a pivoting movement of the actuating means. Hence when the actuating means is turned about the axis of rotation of the rotary cylinder through an angle, this subsequently causes the closing movement of the clamping elements to take place in a zone which, by comparison with the preceding zone, is precisely turned through this particular angle. Thus the effect accomplished with the actuating means is that the zone of the closing movement of the clamping elements is adapted to be varied by a pivoting movement about the axis of rotation of the rotary cylinder precisely as is necessary for the particular angle at which the epilation appliance is placed against the skin. For example, when the user places the epilation appliance on the skin at a particular angle of inclination, a turning movement of the actuating means about the axis of rotation of the rotary cylinder has the effect that also the angular range within which the closing movement of the clamping elements takes place is varied by this particular angle of inclination, so that the clamping elements will continue to execute the closing movement precisely the moment when the rotary cylinder is opposite the skin. This ensures that the clamping elements catch and extract the hairs reliably at all times. Futile plucking operations or the like accompanied by pain are avoided positively.

It is of particular advantage for the actuating means to include at least one pressure element and one actuating element providing for adjustment of the clamping element(s).

Using a turning movement of the pressure element about the axis of rotation of the rotary cylinder it is possible to obtain a particularly simple design implementation regarding the adjustment of the zone of the closing movement of the clamping elements. For this purpose, the pressure element may be mounted on a disk, for example, which in turn is rotatable about the axis of rotation of the rotary cylinder.

In an advantageous aspect of the present invention, provision is made for a transmission means for coupling the sensing means with the actuating means.

The transmission means serves the purpose of transmitting the angle detected by the sensing means to the actuating means. The angle at which the epilation appliance is placed against the skin and which is detected by means of the engaging surface is transmitted to the actuating means by the transmission means. The actuating means adjusts the zone of the closing movement of the clamping elements in dependence upon the received angle in such manner that the closing movement takes place precisely the moment when the clamping elements are positioned in the predetermined zone, in particular facing the skin. The transmission means thus ensures an automatic coupling between the sensing means and the actuating means and, hence, at all times a correct adjustment of the zone of the closing movement in dependence upon the angle at which the user places the epilation appliance against the skin.

In an advantageous further aspect of the present invention, the transmission means includes a pivotal swinging member or the like which is coupled with the sensing means and the actuating means via driving elements.

This represents a particularly simple and low-cost design implementation of the transmission means. More particularly, the swinging member makes sure that the angle at which the epilation appliance is placed against the skin is transmitted to the actuating means directly and accurately. It will be understood, of course, that the transmission means may also be configured as a gear drive or some other coupling mechanism.

Particularly advantageously, the swinging member is made of a flexible material, in particular a plastics material.

In this manner bending movements in the swinging member which occur during the pivoting of the swinging member for design reasons or due to manufacturing tolerances may be compensated for in a simple way.

It is particularly advantageous for the transmission means to include a pin engaging in an oblong hole of the sensing means, and a further pin engaging in an oblong hole of the actuating means.

The two pins present driving elements providing, through the oblong holes, for coupling between the sensing means and the actuating means. This presents a simple and yet reliable design possibility to implement the transmission means.

In an advantageous further aspect of the present invention, the relative distance of the pivot axis of the sensing means to the pin engaging in the oblong hole of the sensing means is approximately equal to the relative distance of the pin engaging in the oblong hole of the actuating means to the axis of rotation of the rotary cylinder.

The effect achieved thereby is that the detected angle at which the epilation appliance is placed against the skin is transmitted to the actuating means unchanged. Hence the zone of the closing movement of the clamping elements is adjusted precisely by the same angle at which the epilation appliance is placed against the skin. There is thus a 1:1 transmission ratio of the detected angle at which the epilation appliance is placed against the skin to the angle by which the zone of the closing movement is adjusted.

In another advantageous aspect of the present invention, the zone of the closing movement is adjustable by an angle of up to 60 degrees, approximately, in particular by an angle of 35 degrees, approximately.

This covers the angular range within which a user typically places the epilation appliance on the skin. Within this typical angular range it is hence ensured that the zone of the closing movement of the clamping elements is automatically adjusted in conformity with the angle at which the epilation appliance is placed against the skin, enabling the epilation appliance to be used and function perfectly at all times.

It is of particular advantage to arrange the zone of the closing movement in a home position approximately in the main plane of extension of the epilation appliance and to enable the zone of the closing movement to be deflectable from the main plane of extension by an angle of about 17.5 degrees. With symmetrically built appliances the main plane of extension is understood to mean, for example, a central transversal plane, while with asymmetrically built appliances it means a plane suited to indicate the orientation of the appliance relative to the skin or some other direction.

This range of +/−17.5 degrees has proven to be particularly suitable in practice and can be implemented with relatively little technical effort and hence at low cost.

In an advantageous embodiment of the present invention, the transmission means is capable of transmitting the angle detected by the sensing means to the actuating means at a transmission ratio of essentially 1:1. This means that the actuating means is adjusted essentially by the angle detected by the sensing means.

It is particularly advantageous for the rotary cylinder and the means for adjusting the zone of the closing movement to form an independently handleable unit. While in the prior art the means for adjustment or the actuating means is formed fast with the housing, the invention makes provision for the actuating means to be associated with the rotary cylinder, which enables an adjustment of the actuating means relative to the housing.

An advantageous further extension of this aspect resides in that the means comprise at least one actuating means which is pivotal or rotary about an axis of the rotary cylinder.

Still further, it is advantageous for the actuating means to be adjustable or actuatable in dependence upon the detected angle.

In another particularly advantageous embodiment of the present invention, which may find application also independently of the particular positioning of the pivot axis relative to the axis of rotation of the rotary cylinder, the means for adjusting the zone of the closing movement or the means for detecting the angle at which the epilation appliance is placed against the skin, are arranged adjacent to the rotary cylinder, and the rotary cylinder, meaning the clamping elements, is/are engageable with the user's skin particularly directly. By moving said means from the clamping area proper of the rotary cylinder, that is, the area of the clamping elements of the rotary cylinder, and arrange them adjacent to the rotary cylinder, the rotary cylinder, that is, the clamping elements disposed in the rotary cylinder, is/are capable of engaging the user's skin directly. An impediment of the type of the U-shaped yoke of the prior art is not present in this particularly advantageous independent embodiment of the epilation appliance, so that this approach contributes also to further improving the effectiveness/efficiency of epilation.

In a particularly advantageous embodiment of the present invention, it is proposed that the means be configured as a correcting means and mounted adjustably relative to the rotary cylinder. In this arrangement a variation of the position of the correcting means—relative to the rotary cylinder or appliance housing—results in a variation of the closing instant or closing location of the clamping elements. Such a correcting means advantageously produces an automatic adaptation of the closing location of the clamping elements without making it necessary for the user to make allowance for the angle at which the appliance is placed against the skin surface subject to epilation. Such a correcting means may be constructed, for example, as a section of the housing receiving the epilation head, with the correcting means performing an essentially rectilinear movement when pressure is exerted on the skin. It is, however, also possible for a correcting means of the invention to be constructed as a component separate from the housing of the epilation head, for example, as a rod, a plate, a ball, a pin or the like. On contact with the skin, such correcting means may perform both a straight-line and an arcuate movement to thereby produce an adjustment of the closing location or closing instant of the clamping elements.

In a further aspect of the present invention, the correcting means is arranged laterally adjacent to the rotary cylinder and is movable across the user's skin essentially in unison with the rotary cylinder. Said correcting means may be constructed such as to substantially encompass the rotary cylinder, being arranged adjacent to the ends of the rotary cylinder or alternatively, as seen looking in the direction of travel of the epilation appliance, in advance of or behind the rotary cylinder. A simple configuration of the correcting means affording ease of manufacture is thus proposed, which, by virtue of its essentially joint movement with the rotary cylinder across the user's skin, advantageously produces a direct and reliable adjustment of the closing instant of the clamping elements.

The correcting means is further spring mounted on a supporting structure provided to receive the rotary cylinder. In lieu of the supporting structure it is also possible for the rotary cylinder to be received in a head housing and for the correcting means to be spring mounted thereon. The advantageous effect accomplished by spring mounting the correcting means is that upon placement of the rotary cylinder on the skin to be epilated also the correcting means is guided across the skin essentially at a constant contact pressure, whereby a precise adaptation of the closing instant is ensured at all times.

In a particularly advantageous embodiment of the present invention, the correcting means is constructed essentially as a yoke, as a frame or similar component having at least one substantially longitudinal straight-line contact surface for seating engagement with the user's skin. Hence an easy-to-manufacture correcting means is proposed which, owing to the elongated contact surface, permits good guidance on the skin and, being constructed of few slim components, enables the user to have an unobstructed view of the skin surface needing to be epilated. The use of a frame as, for example, a quadrangular frame, which surrounds the contact surface of the rotary cylinder with the skin essentially outside, provides a further correcting means which follows the contour of the skin surface to be epilated reliably.

A still further proposal includes providing the correcting means with a roller and/or a comb arranged essentially parallel to the axis of rotation of the rotary cylinder. In this arrangement the comb is disposed advantageously at the leading edge of a frame-shaped correcting means, for example, hence enabling the hairs to be raised with a combing action to enhance the efficiency of the plucking operation. The construction of the correcting means as a roller enables a component to be obtained which moves easily and with little resistance across the skin and which, by reason of the essentially parallel arrangement relative to the axis of rotation of the rotary cylinder, also ensures good engagement with the user's skin.

In a further embodiment of the present invention, the comb and/or the roller has at one or both ends thereof a swivel arm which extends in particular along one or both ends of the rotary cylinder and is mounted for pivotal movement relative to the supporting structure or the appliance housing. Such a construction proposes a simple and in particular torsion resistant correcting means which, in addition, provides a maximum possible skin engaging surface, enabling advantageously the epilation head to be moved across the skin securely without introducing angle displacements of the head vis-à-vis the skin.

In a still further aspect, the correcting means is mounted for pivotal movement essentially about the axis of the rotary cylinder itself or about another axis disposed essentially parallel to the axis of the rotary cylinder. By arranging the correcting means on the axis of the rotary cylinder, a particularly favorable mounting is proposed because the axis of the rotary cylinder exists anyway. However, it can also be considered that provision is advantageously made for pivotally mounting the correcting means about an axis other than the axis of the rotary cylinder.

In yet another aspect, an upper and a lower stop are provided for the correcting means, in particular on the housing of the epilation head, enabling a predesigned pivoting range to be predetermined particularly in cases where the correcting means is pivotally mounted.

Furthermore, the correcting means is biased by means of a spring element in such manner that the correcting means, during use, is advantageously maintained in biased engagement with the user's skin, springing back into the upper stop position automatically after use. This ensures likewise an accurate guidance of the correcting means on the skin subject to epilation.

In a particular aspect of the present invention, the correcting means, in particular the at least one swivel arm of the correcting means, is connected to at least one control element in a manner preventing relative rotation. In this arrangement, the control element is constructed, for example, as a thrust plate with a pressure roller, said pressure roller controlling at least one actuating element for actuating the clamping elements of the rotary cylinder. This is a simple way of ensuring that any movement of the correcting means effects directly an automatic adaptation of the closing instant to the respective contour of the skin surface.

A still further aspect of the present invention proposes arranging in a plane substantially normal to the axis of rotation of the rotary cylinder the axis of rotation of the control element, particularly the pressure roller, relative to the longitudinal axis of the swivel arm in such manner that the included angle defined between the closing instant of the clamping elements during use and the contact location, in particular the contact line between the rotary cylinder and the user's skin, is essentially constant. Such a relative arrangement of the individual components advantageously enables an epilation head to maintain at all times automatically a defined angle of application to the skin surface without requiring the user to concentrate thereon particularly. Hence the functions of threading and clamping the hairs as well as extracting them are performed in best possible manner.

Another proposal includes providing an epilation appliance with an epilation head which is either integrally formed or detachably connected with the epilation appliance, particularly the housing of the appliance.

The aforementioned embodiments concern essentially an epilation appliance with a correcting means adjustable relative to the rotary cylinder for producing an adjustment of the closing location, that is, the closing instant of the clamping elements in the rotary cylinder. In use it is thereby ensured, independently of the angle of application of the epilation appliance to the skin, that the closing location of the clamping elements relative to the point of contact between the rotary cylinder and the skin is maintained essentially constant.

In a further particularly advantageous embodiment of the present invention which may also represent an independent invention, it is proposed connecting the correcting means fast with the rotary cylinder and combining the two components to form a unit adjustably arranged relative to the housing of the epilation appliance. In this embodiment it is also possible for the unit to be comprised, for example, of the correcting means, the rotary cylinder, a motor and a transmission mechanism and for this unit to be pivotally mounted on the appliance housing. This affords the advantage that in use the unit configured as pivoted head is always guided at a constant angle to the skin, regardless of the angle at which the appliance housing is held against the skin. This second significant embodiment of the present invention differs from the aforementioned embodiment substantially in that the closing location of the clamping elements is fixed in the rotary cylinder and that the complete unit formed of at least the rotary cylinder and the correcting means is adjustable relative to the appliance housing, being in particular pivotally mounted thereon.

Further features, application possibilities and advantages of the present invention will become apparent from the subsequent description of embodiments of the invention illustrated in the Figures of the accompanying drawing. It will be understood that any single feature and any combination of single features described or represented by illustration form the subject-matter of the present invention, irrespective of their summary in the patent claims or their back reference, as well as irrespective of their wording and representation in the description and the drawing, respectively.

DETAILED DESCRIPTION

Figure 1:
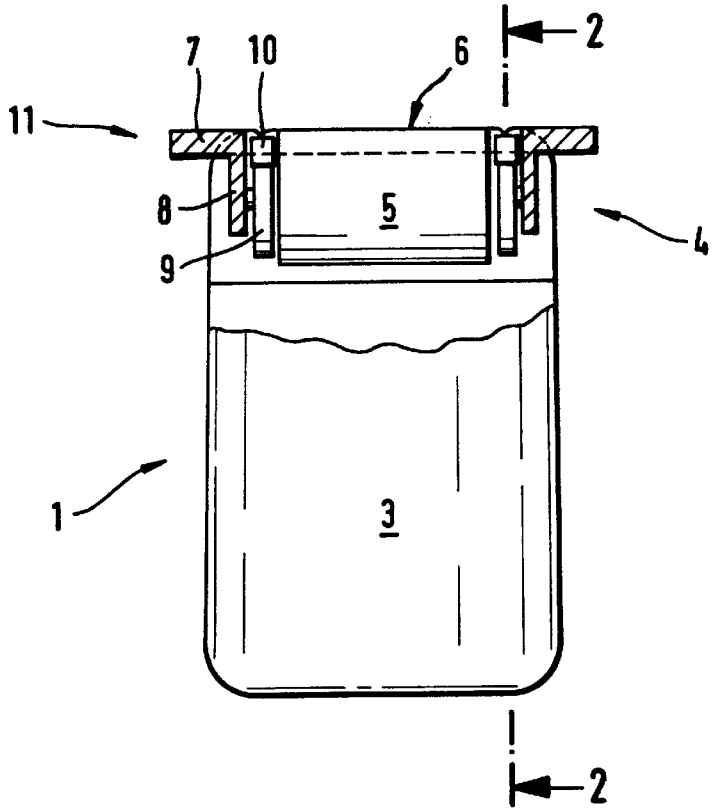
FIG. 1 is a schematic and partially broken away plan view of an epilation appliance.

An epilation appliance (FIG. 1) is substantially comprised of a housing 3 constructed as a gripping portion which accommodates a motor, and an epilation head 4 in which a rotary cylinder 5 is arranged. The cylinder 5 is embraced by a correcting means 11 formed essentially of a frame 7. This frame has its upper side essentially flush with the contact surface 6 of the rotary cylinder 5. The frame 7 is provided with two swivel arms 8 each including a thrust plate 9 with a pressure roller 10, said pressure rollers 10 controlling the actuating elements for actuation of the cylinder's clamping elements which are not shown for the sake of simplicity.

Figure 2:
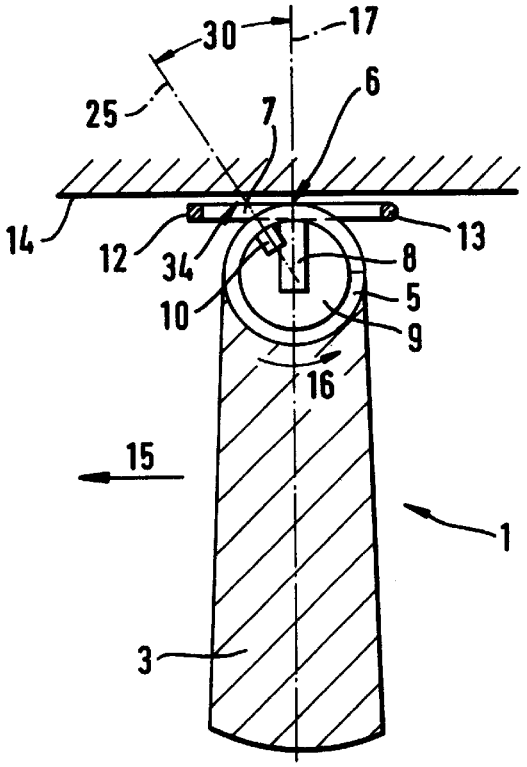
FIG. 2 is a view of the epilation appliance taken along the section line 2—2 of FIG. 1.

A section taken along the line 2—2 of FIG. 1 shows the rotary cylinder 5 (FIG. 2) at the upper end of the housing 3. The frame 7 has its swivel arm 8 mounted for pivotal movement about the axis of rotation of the cylinder 5. The thrust plate 9 connected with the frame 7 carries the pressure roller 10 which forms with its axis of rotation 25 an angle 30 with the longitudinal axis 17 of the housing 3 and hence determines the closing instant of the clamping elements. Viewed in the direction of rotation of the rotary cylinder, this instant trails, for example, by about 35° behind the longitudinal axis 17 of the appliance. On its upper side the frame 7 carries a comb 12 and a roller 13 extending essentially parallel to the axis of rotation of the cylinder 5. In this arrangement, for example, the comb 12 is disposed in advance of the rotary cylinder 5, provided that the epilation appliance 1 is moved in the direction of travel 15 relative to the skin 14 and the rotary cylinder 5 rotates in a direction 16. In the representation shown in which the appliance 1 is held so its longitudinal axis 17 forms an angle of about 90° with the skin 14, the contact surface 6, which may also be a contact line, coincides essentially with the longitudinal axis 17 of the appliance 1. However, as soon as the appliance 1 is guided at an angle other than 90° to the skin 14 to be epilated, the contact surface 6 will experience a displacement relative to the longitudinal axis 17 of the appliance.

Figure 3:
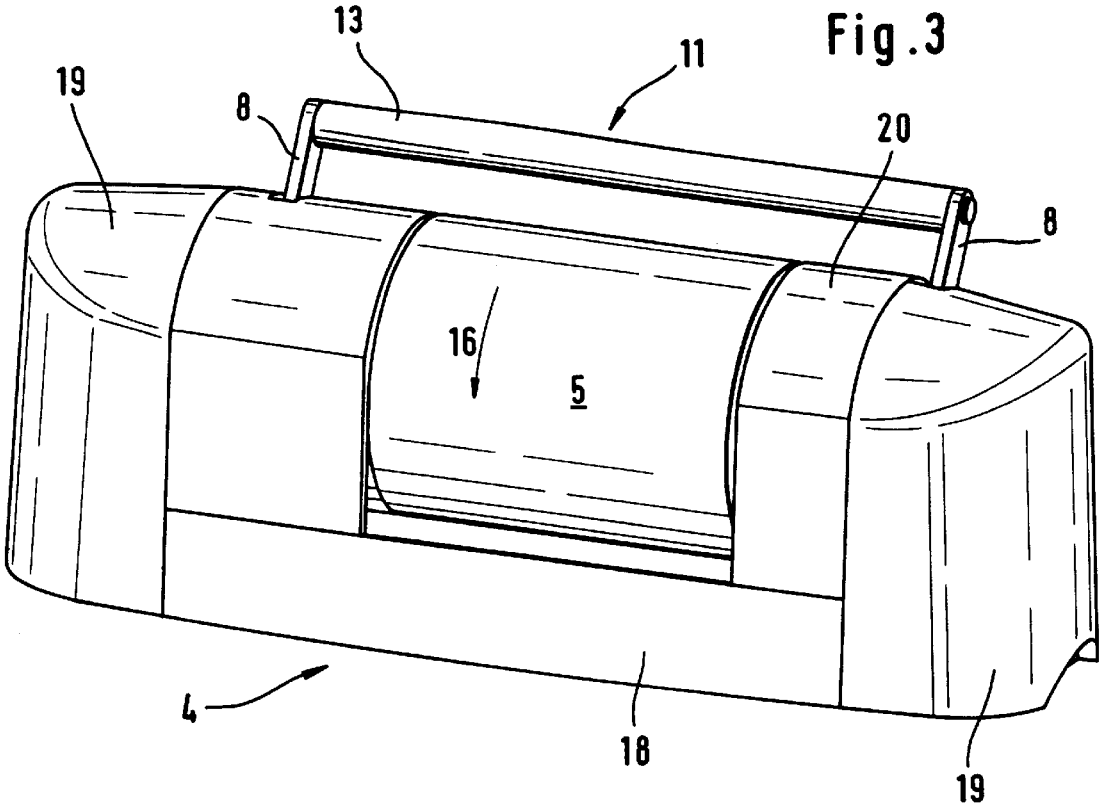
FIG. 3 is a perspective view, on an enlarged scale, of an epilation head.

An epilation head 4 of the present invention (FIG. 3) is comprised of a supporting structure 18 mounting the rotary cylinder 5, the correcting means 11 as well as the housing end covers 19 and a housing section 20. The correcting means 11 includes the two lever type swivel arms 8 mounted in the housing sections 20 at either end of the cylinder 5. The swivel arms 8 are interconnected by a rod carrying a rotary roller 13. This roller extends essentially parallel to the axis of rotation of the cylinder 5 and is arranged in advance of the rotary cylinder 5 as seen looking in the direction of rotation 16 of the cylinder 5. Substituting the correcting means 11, the provision of a housing section 20 may be contemplated which, for example, is adjustable relative to the supporting structure 18 and protrudes beyond the housing cover 19 in a direction vertical to the axis of rotation of the cylinder 5. On contact of the rotary cylinder 5 and the housing section 20 with a skin surface needing to be epilated, the housing section 20 would be in a position to perform a movement relative to the supporting structure 18 and thus produce an adjustment of the closing instant of the clamping elements.

Figure 4:
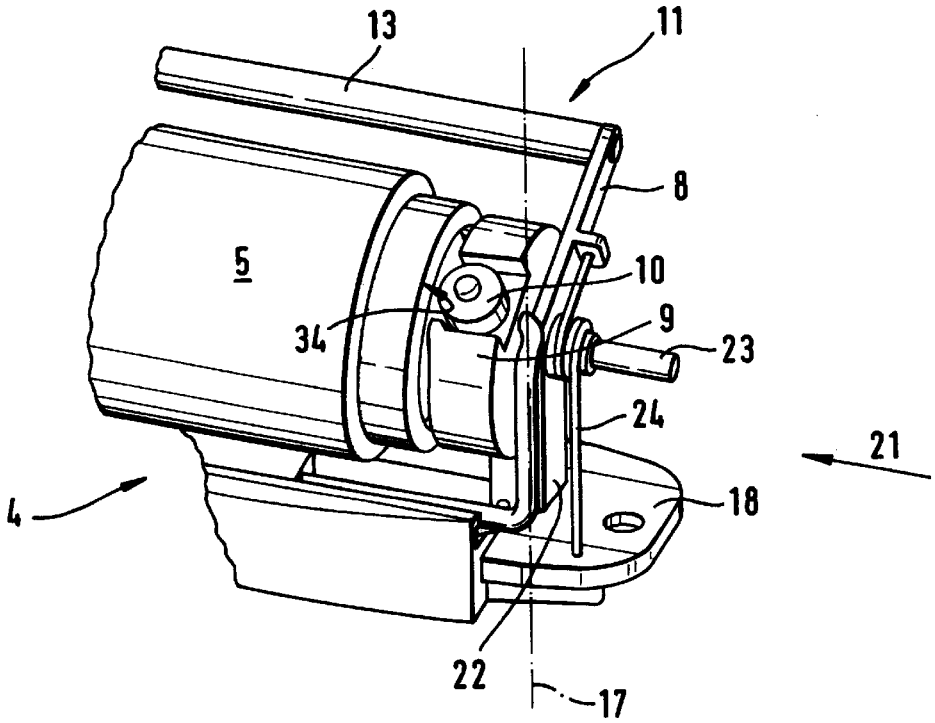
FIG. 4 is a view of a portion of the epilation head of FIG. 3, absent the housing cover.

When detaching the housing sections 19 and 20 from an epilation head 4 (FIG. 4), it will become apparent that the cylinder 5 is fastened to the supporting structure 18 by means of an axle 23. Furthermore, the correcting means 11 is pivotally mounted on the axle 23, the swivel arm 8 having its lower leg 22 extend approximately parallel to the longitudinal axis 17 of the epilation appliance. Attached to the outside of the swivel arm 8 is a spring 24 taking support upon the supporting structure 18 and biasing the correcting means 11. Between the swivel arm 8 and the end of the rotary cylinder 5 is a thrust plate 9 with a pressure roller 10, a pin being provided for connection of the thrust plate 9 with the leg 22 of the swivel arm 8 in a manner preventing relative rotation, and the pressure roller 10 determining the closing instant, that is, the closing location 34 of the clamping elements. The pin allows a small angle of movement of the thrust plate 9 relative to the rotary cylinder 5. The two endwise thrust plates 9 are braced by a bow spring.

Looking at the end of the epilation head 4 from an angle 21 (FIG. 5), it will be seen that the lower leg 22 of the swivel arm 8 extends approximately parallel to the longitudinal axis 17 of the appliance. By contrast, the longitudinal axis 26 of the swivel arm 8 is arranged to form an angle 33 with the longitudinal axis 17 of the appliance. Another angle 30 is defined between the axis of rotation 25 of the pressure roller 10 and the housing's longitudinal axis 17, which angle trails behind the contact location 6 between the cylinder 5 and the skin surface to be epilated by about 35°. The position of the correcting means 11 shown in this Figure corresponds approximately to the in-use state of the epilation head 4 in which the swivel arm 8 is about biased into abutment with the lower stop. The imaginary point of intersection between the axis of rotation 25 of the pressure roller 10 and the skin to be epilated corresponds to the closing location or closing instant 34.

Figure 5:
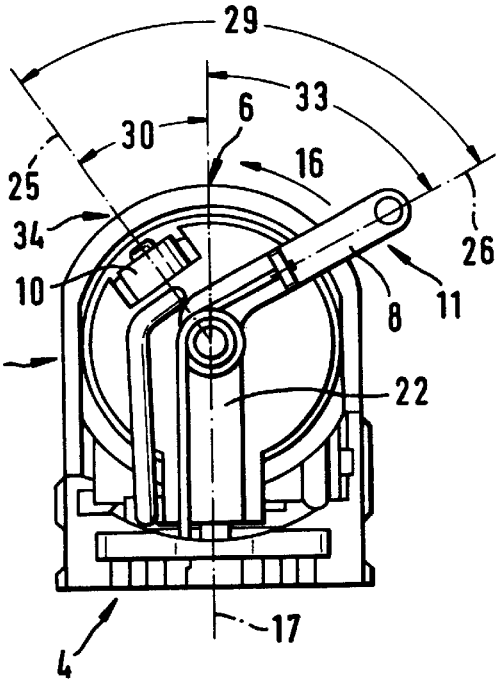
FIG. 5 is a view of an epilation head as seen looking from the direction 21 of FIG. 4.
Figure 6:
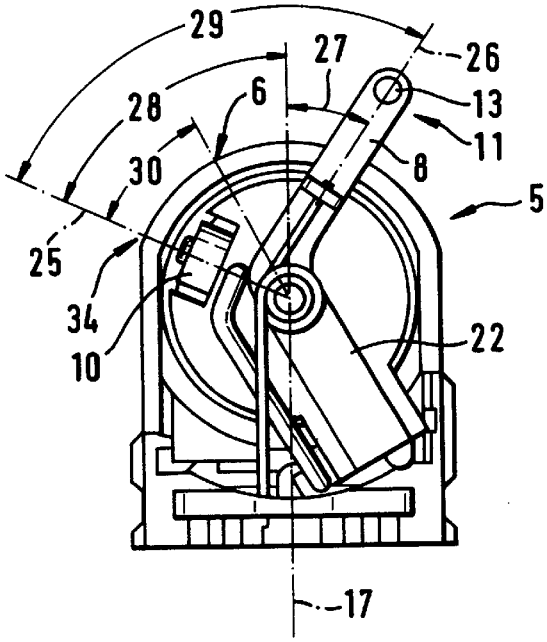
FIG. 6 is a view of an epilation head of FIG. 5, but showing a correcting means in its upper stop position.

In an unbiased, unloaded condition (FIG. 6), the correcting means 11 is swiveled with respect to the representation of FIG. 5; as a result, the leg 22 is no longer parallel to the longitudinal axis 17, and the longitudinal axis 26 of the swivel arm 8 defines an angle 27 with the longitudinal axis 17 of the appliance. An angle 28 is defined between the axis of rotation 25 of the pressure roller 10 and the longitudinal axis, with the total angle 29 of the two single angles 27 and 28 equaling the angle 29 of FIG. 5. If a user were to place an epilation head 4 on the skin according to the representation of FIG. 6, the contact surface between the rotary cylinder 5 and the skin to be epilated would lie approximately at the contact location 6 identified by an arrow. The included angle 30 defined between the contact location 6 and the axis of rotation 25 of the pressure roller 10 would thus correspond again to the angle 30 of the representation of FIG. 5, so that the closing location 34 of the clamping elements of the rotary cylinder 5 ensures an optimum clamping and plucking function in any position of the correcting means 11.

Figure 7:
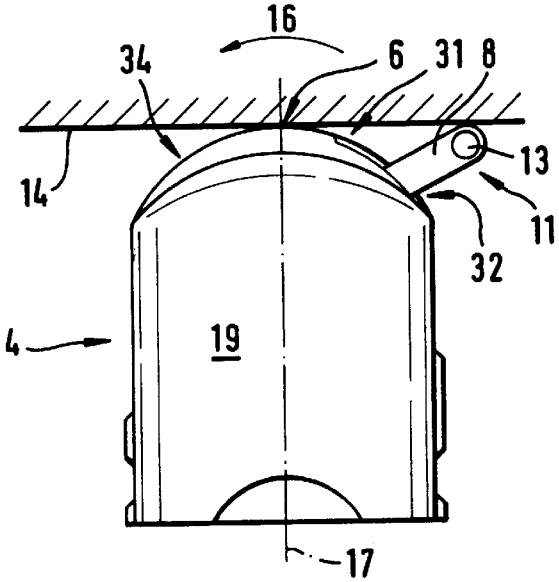
FIG. 7 is a side view of an epilation head in use.
Figure 8:
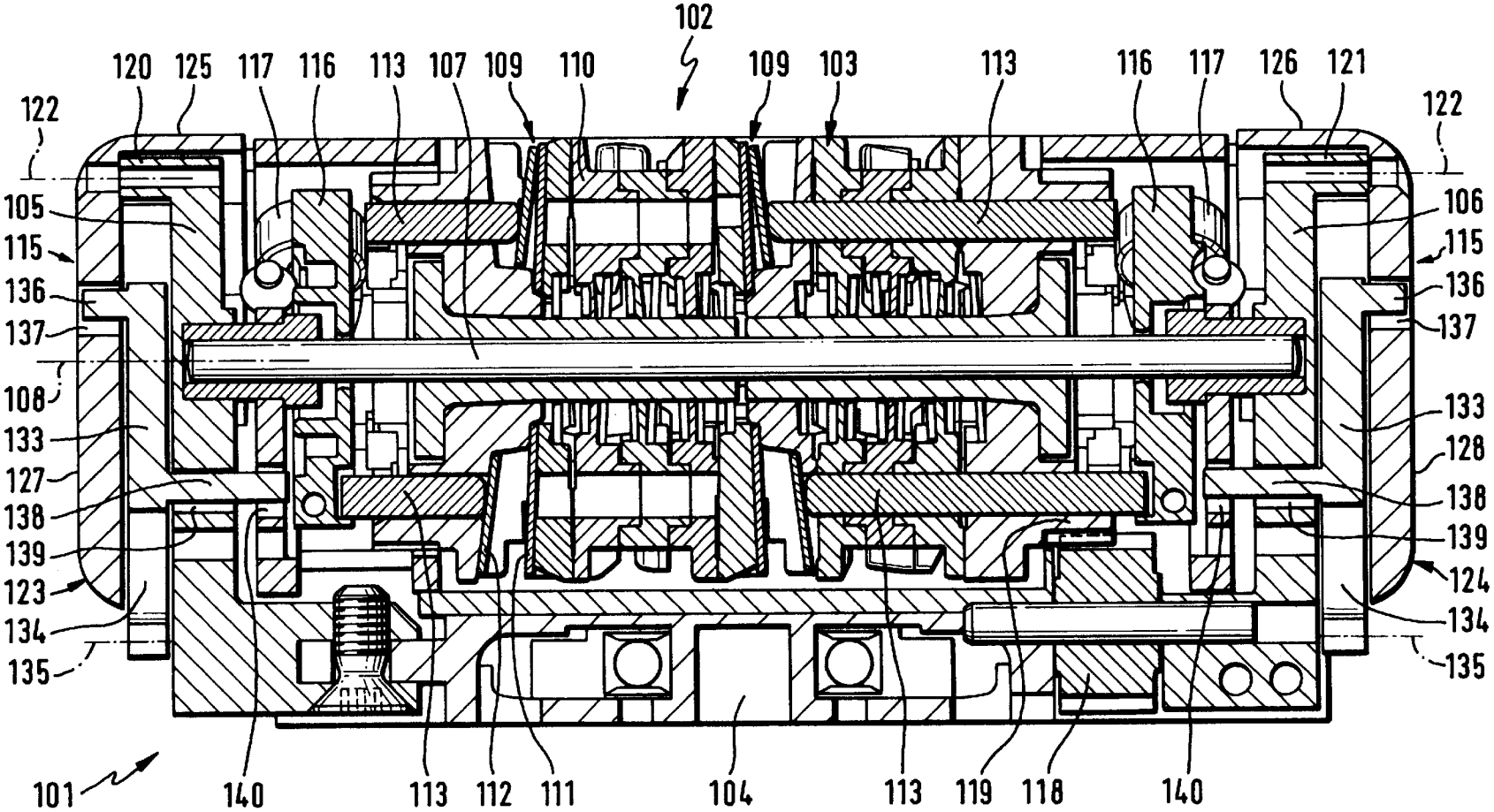
FIG. 8 is a schematic longitudinal sectional view of an embodiment of an epilation appliance of the present invention.

In use of the epilation head 4 of the present invention (FIG. 7), the rotary cylinder has its contact surface 6 in engagement with the skin surface 14 subject to epilation. The closing location 34 of the clamping elements trails behind the contact location 6 in the direction of rotation 16 of the cylinder. Furthermore, the correcting means 11 is shown in biased abutment in which condition the roller 13 is also in engagement with the skin 14 while the swivel arm 8 abuts the lower stop 32. As soon as the epilation appliance or the head 4 is disengaged from the skin 14, the swivel arm 8 returns to its home position in which it abuts the upper stop 31 of the housing cover 19.

FIGS. 8 to 13 illustrate an epilation appliance 101 intended for the removal of hairs on the human body. The epilation appliance 101 includes a gripping portion accommodating, among other components, a drive motor. Mounted on the gripping portion, particularly detachably, is an epilation head 102 in which a rotary cylinder 103 is received.

The gripping portion and the epilation head 102 form approximately a right parallelepipedal body with rounded corners, at the one end of which the rotary cylinder 103 is arranged. Width and height of the right parallelepipedal body correspond approximately to width and diameter of the rotary cylinder 103. The length of the right parallelepipedal body depends on the dimension of the gripping portion in a direction transverse to the rotary cylinder 103. The length and width dimensions of the right parallelepipedal body span between them a main plane of extension H of the epilation appliance 101 which, in the direction of the height of the right parallelepiped, is determined by the axis of rotation of the rotary cylinder 103.

A user may grasp the epilation appliance 101 by its gripping portion, placing the rotary cylinder 103 on the skin. When in engagement with the skin, the rotary cylinder 103 makes line contact with the skin in a direction oriented approximately parallel to the main plane of extension H of the epilation appliance 101. In dependence upon the angle of inclination at which the user places the epilation appliance 101 against the skin, this contact line is situated on the circumference of the rotary cylinder 103.

On its side close to the gripping portion the epilation head 102 is provided with a housing portion 104 having two bracket arms 105, 106 projecting at about right angles in a direction facing away from the gripping portion. Disposed within the U-shape formed by the housing portion 104 and the two bracket arms 105, 106 is a shaft 107 extending approximately parallel to the housing portion 104 and carrying the rotary cylinder 103. The shaft 107 is journaled for rotation in the two bracket arms 105, 106, hence forming the axis of rotation 108 for the rotary cylinder 103. The axis of rotation 108 lies in the main plane of extension H of the epilation appliance 101.

Mounted on the shaft 107 are a plurality of clamping element pairs 109 between which holding and spacing disks 110 are provided. Each of the pairs 109 of clamping elements includes one stationary clamping element 111 and one movable clamping element 112, the movable clamping element being actuatable by an actuating element 113. In a non-actuated position, the clamping elements 111, 112 of the clamping element pairs 109 are maintained in spaced relation to each other, whilst in an actuated closing position pressure acts on the free ends of the clamping elements 111, 112, urging them into abutting engagement with each other. The pressure is produced by the actuating elements 113 and is adjustable by means of a spring 114 or the like. A rotary cylinder of this type is described in the not prior published German patent application DE 196 31 419 which is hereby incorporated in the disclosure content of the present application by express reference.

The actuating elements 113 are arranged approximately parallel to the shaft 107, extending from the associated movable clamping element 112 to one of the two ends 115 of the rotary cylinder 103. The actuating elements 113 are of an elongated configuration and longitudinally slidably mounted in the rotary cylinder 103, being thus movable from the non-actuated into the actuated position and vice versa.

Arranged at either end 115 of the rotary cylinder 103 is a respective disk 116 which is pivotal about the axis of rotation 108 of the rotary cylinder 103. The home position of FIGS. 10 and 11 and the deflected position of FIGS. 12 and 13 differ, among other things, by different pivot positions of the two disks 116. Each of the two disks 116 is provided with a pressure element 117 whose axis is disposed approximately radially to the axis of rotation 108. The disk 116 with the pressure element 117 which is, for example, a pressure roller, are not coupled with a drive mechanism of the rotary cylinder 103 and therefore do not partake in a rotary movement of the rotary cylinder 103. With their one free end the actuating elements 113 face the disk 116 and hence the pressure element 117. With their other free end the actuating elements abut the movable clamping element 112. The pressure element 117 and the rotary cylinder 103 thus form an assembly in which the pressure element 117, rather than being formed fast with the housing, is displaceable relative to the axis of rotation of the rotary cylinder 103.

To drive the rotary cylinder 103 a gear 118 coupled with the drive motor is mounted for rotation in the housing portion 104, said gear meshing with a toothed ring 119 arranged on the outer circumference of the rotary cylinder 103.

The pressure element 117 and the actuating elements 113 are in such relative arrangement and orientation that on a rotation of the rotary cylinder 103 about the axis of rotation 108 the actuating elements 113 are acted upon in succession by the pressure element 117 by reason of the non-rotating disk 116. In consequence, the clamping elements 111, 112 execute a closing movement from the non-actuated position into the actuated closed position.

The pressure element 117 is disposed on the circumference of the disk 116 in such manner that the closing movement of the clamping elements 111, 112 with the rotary cylinder 103 rotating takes place approximately in the area of a line L on the circumference of the rotary cylinder 103. In the home position shown in FIGS. 10 and 11, the line L represents the highest or outermost line or the zenith of the rotary cylinder 103 with respect to the main plane of extension H of the epilation appliance 101. In the deflected position shown in FIGS. 12 and 13, however, the line L has been subject to an angular displacement, as will be explained in the following.

When a user holds the epilation appliance 101 with its rotary cylinder 103 so that an angle of about 90° is formed between the main plane of extension H and the skin, the line L will form a contact line between the skin and the rotary cylinder 103, which line is disposed in the main plane of extension H. When the rotary cylinder 103 then performs a rotary movement, the closing movement of the clamping elements 111, 112 will take place approximately in the area of this contact line. Hairs present in the area of this contact line will be clamped between the closing clamping elements 111, 112 and extracted from the skin as the rotary cylinder 103 continues rotating.

At the free ends of the two bracket arms 105, 106 is a respective pin 120, 121 which, facing away from each other, project outwardly. The two pins 120, 121 define a pivot axis 122 disposed approximately parallel to the axis of rotation 108 of the rotary cylinder 103 and lying in the main plane of extension H. Furthermore, the pivot axis 122 is disposed approximately in the area of the circumference of the rotary cylinder 103, with the relative distance of the pivot axis 122 to the axis of rotation 108 of the rotary cylinder 103 being slightly smaller than the radius of the rotary cylinder 103.

Alternatively, it is possible to arrange the pivot axis 122 at a distance to the axis of rotation 108 of the rotary cylinder 103 which is greater than or equal to the radius of the rotary cylinder 103.

Each of the two pins 120, 121 mounts a side member 123, 124 for pivotal movement thereon. Each side member 123, 124 has an approximately plane, rectangular upper surface 125, 126 and a partially radiused end surface 127, 128. The upper surfaces 125, 126 are arranged in a direction approximately transverse to the main plane of extension H and have each a dimension corresponding approximately to the diameter of the rotary cylinder 103 in a direction transverse to the axis of rotation 108 of the rotary cylinder 103. In the direction of the axis of rotation 108 of the rotary cylinder 103, the upper surfaces 125, 126 have a dimension as is necessary for the accommodation of components arranged underneath. The dimension of the end surfaces 127, 128 is likewise selected to cover adequately the underlying components.

In a direction transverse to the axis of rotation 108 of the rotary cylinder 103, a respective bar 129, 130 is mounted on the two ends of the surfaces 125, 126. The side members 123, 124 are thus connected with each other by means of the bars 129, 130. The alignment of the bars 129, 130 is about parallel to the axis of rotation 108 of the rotary cylinder 103 and the pivot axis 122 of the side members 123, 124, in addition to being in approximately parallel arrangement to each other. Rotary rollers 131, 132 or the like are push-fitted to the bars 129, 130.

The two side members 123, 124 and the two bars 129, 130 form a unit which is pivotal about the pivot axis 122 formed by the pins 120, 121. The two bars 129, 130 and the two upper surfaces 125, 126 of the side members 123, 124 span between them an engaging surface A which is equally pivotal about the pivot axis 122. The engaging surface A is arranged at a small relative distance to the pivot axis 122 in the direction of the main plane of extension H. At least in the home position shown in FIGS. 10 and 11, the engaging surface A thus forms a surface which is approximately tangent to the circumference of the rotary cylinder 103.

When the user places the epilation appliance 101 in contact with the skin, the engaging surface A is largely automatically aligned approximately parallel to the skin by the two bars 129, 130. At the same time, the engaging surface A always forms with the main plane of extension H of the epilation appliance 101 precisely the same angle of inclination at which the user places the epilation appliance 101 against the skin.

When the user positions the epilation appliance 101 so that its main plane of extension H is at approximately right angles to the skin, the engaging surface A is approximately transverse to the main plane of extension H. When the user positions the epilation appliance 101 so that its main plane of extension H forms an angle of inclination with the skin, the engaging surface A forms an angle with the main plane of extension H which amounts to 90° plus or minus that angle of inclination (depending on the direction of inclination).

In the area of attachment of the two bracket arms 105, 106 to the housing portion 104, provision is made for a respective swinging member 133 which is arranged on the sides of the bracket arms 105, 106 facing away from each other. Each swinging member 133 is of an approximately U-shaped configuration, having the free ends of its two legs 134 pivotally connected to the associated bracket arm 105, 106. The pivot axes 135 of the two legs 134 of the two swinging members 133 coincide, extending about parallel to the axis of rotation 108 of the rotary cylinder 103 and about symmetrically on both sides of the main plane of extension H.

Approximately in the area of the junction of the two legs 134, each swinging member 133 has a pin 136 projecting outwardly from the sides facing away from each other. The pins 136 are aligned approximately parallel to the axis of rotation 108 of the rotary cylinder 103 and lie in the main plane of extension H in the home position shown in FIGS. 10 and 11. Each pin 136 is associated with an oblong hole 137 provided in the respective end surfaces 127, 128 of the two side members 123, 124, through which the respective pin 136 passes. In the home position of FIGS. 10 and 11, the oblong holes 137 lie in the main plane of extension H of the epilation appliance 101.

Provided likewise approximately in the area of the junction of the two legs 134 is a further pin 138 projecting inwardly from the facing sides of the two swinging members 133. The pins 138 are aligned approximately parallel to the axis of rotation 108 of the rotary cylinder 103 and lie in the main plane of extension H in the home position shown in FIGS. 10 and 11. Each pin 138 is associated with an opening 139 provided in each of the two side members 123, 124, through which the respective pin 138 is passed. In the home position of FIGS. 10 and 11, the openings 139 lie approximately transverse to the main plane of extension H of the epilation appliance 101. Furthermore, each of the pins 138 is associated with an oblong hole 140 provided in each of the two disks 116 of the rotary cylinder 103, through which the respective pin 138 passes. In the home position of FIGS. 10 and 11, the oblong holes 140 lie in the main plane of extension H of the epilation appliance 101.

A pivotal movement of the engaging surface A and hence of the side members 123, 124 about the pivot axis 122 formed by the pins 120, 121 is transmitted through the oblong holes 137 and the pins 136 acting as driving elements to the swinging members 133. The swinging members 133 are thus caused to perform a corresponding pivoting movement about the axes 135. This pivoting movement of the swinging members 133 is transmitted, through the pins 138 acting a further driving elements, and the oblong holes 140, to the disks 116 of the rotary cylinder 103. During the pivoting movement the pins 138 pass through the openings 139 without acting on them or being acted upon by them. The disks 116 of the rotary cylinder 103 and hence the actuating wheels 117 perform equally the pivoting movement of the side members 123, 124 and hence of the engaging surface A. As this occurs, the disks 116 pivot about the axis of rotation 108 of the rotary cylinder 103.

Figure 9:
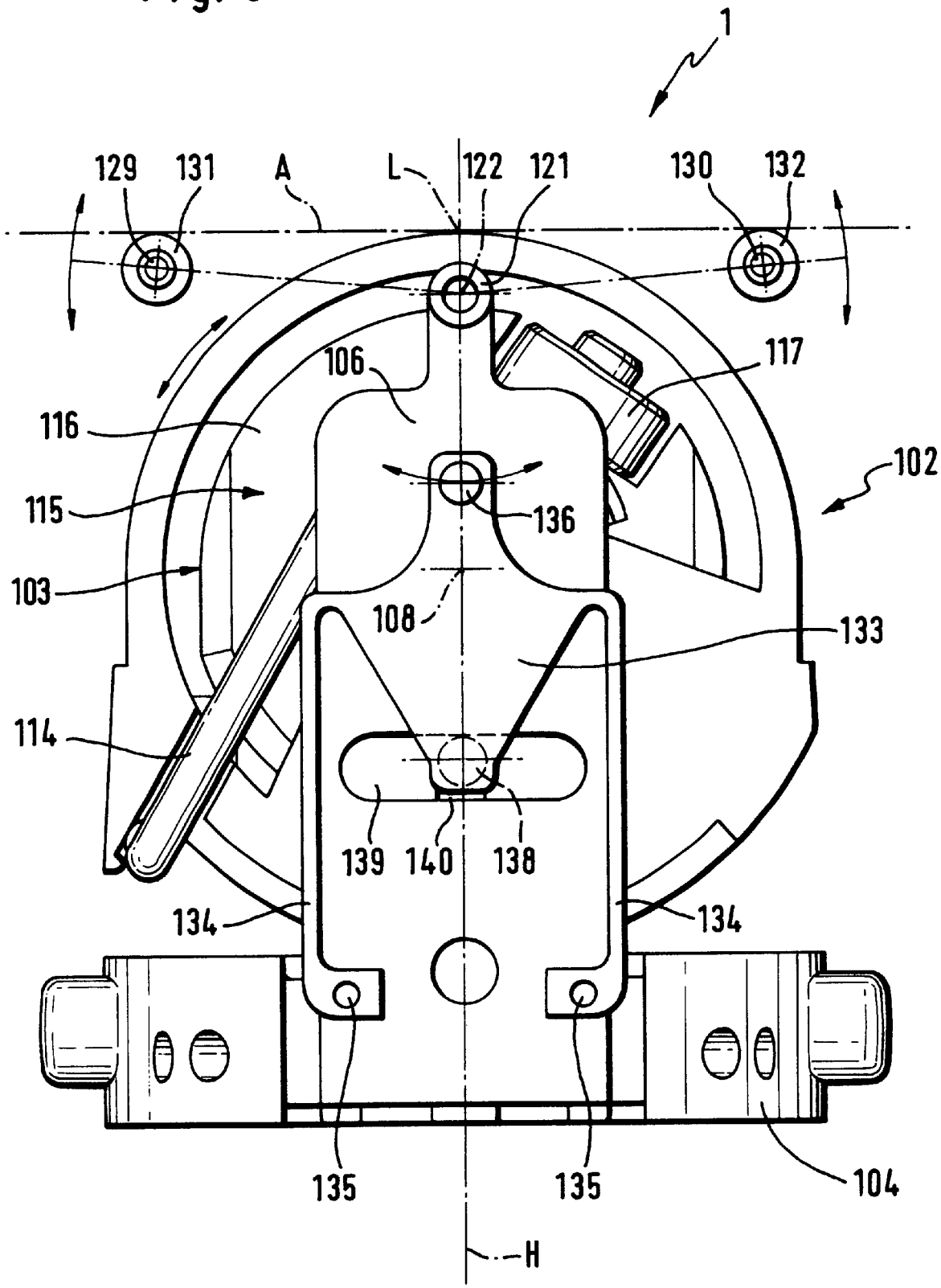
FIG. 9 is a schematic side view of the epilation appliance of FIG. 8, with the side member removed.

As becomes apparent particularly from FIG. 9, the relative distance of the pivot axis 122 formed by the pins 120, 121 to the pins 136 and the relative distance of the pins 138 to the axis of rotation 108 of the rotary cylinder 103 are approximately equal. In consequence, a pivoting movement of the side members 123, 124 through a particular angle produces a pivoting movement of the disks 116 through said same angle.

Figure 10:
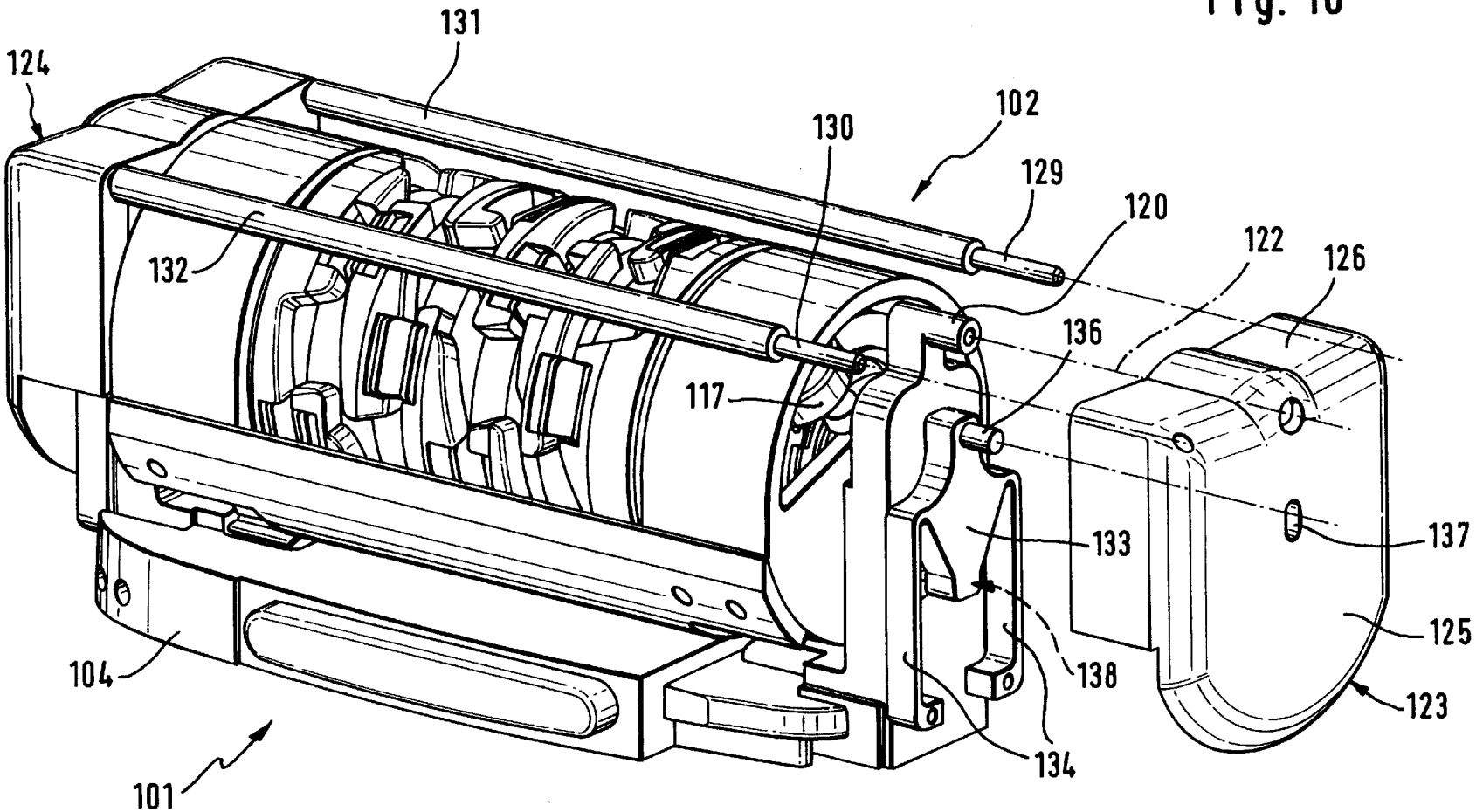
FIGS. 10 and 11 are, respectively, schematic perspective and side views of the epilation appliance of FIG. 8 in a home position.
Figure 11:
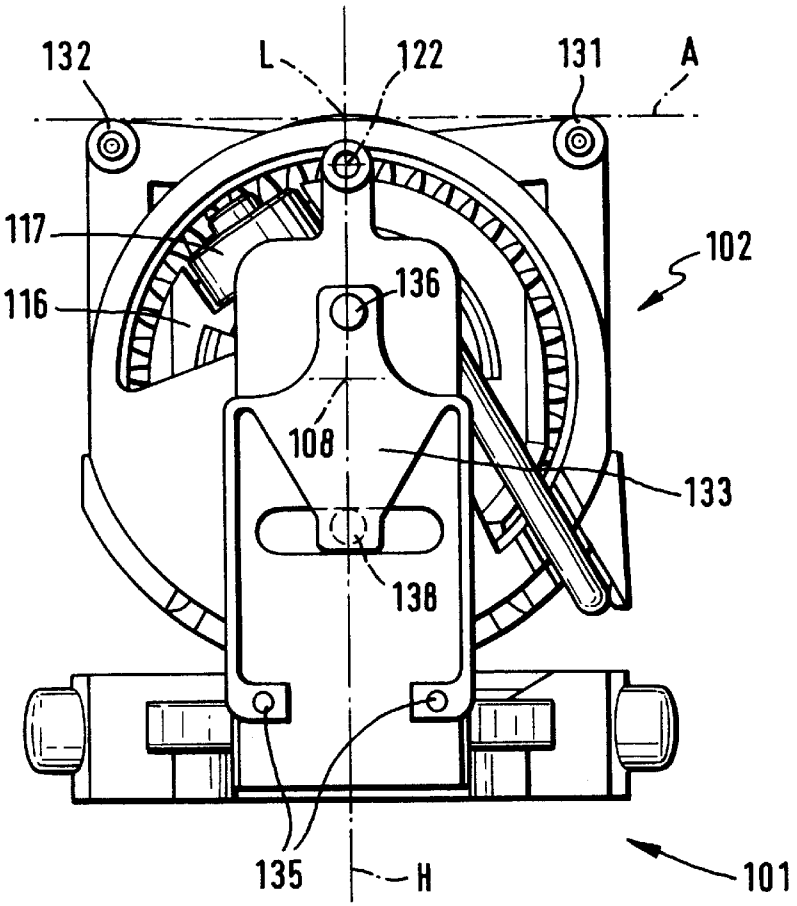

In the home position of FIGS. 10 and 11, the engaging surface A is approximately transverse to the main plane of extension H of the epilation appliance 101, and the pins 136 and the pins 138 as well lie in the main plane of extension H. As a result, the disks 116 are not deflected, in this home position the line L thus representing the highest or outermost line or the zenith of the rotary cylinder 103 with respect to the main plane of extension H of the epilation appliance 101. When the user places the epilation appliance 101 in contact with the skin at an angle of about 90° to the main plane of extension H, which corresponds to the home position of FIGS. 10 and 11, the closing movement of the clamping element pairs 109 will take place in the area of the line L and hence about precisely along the line of contact between the rotary cylinder 103 and the user's skin. Hairs present in this area will be caught by the pairs 109 of clamping elements and extracted as the rotary cylinder 103 continues rotating.

Figure 13:
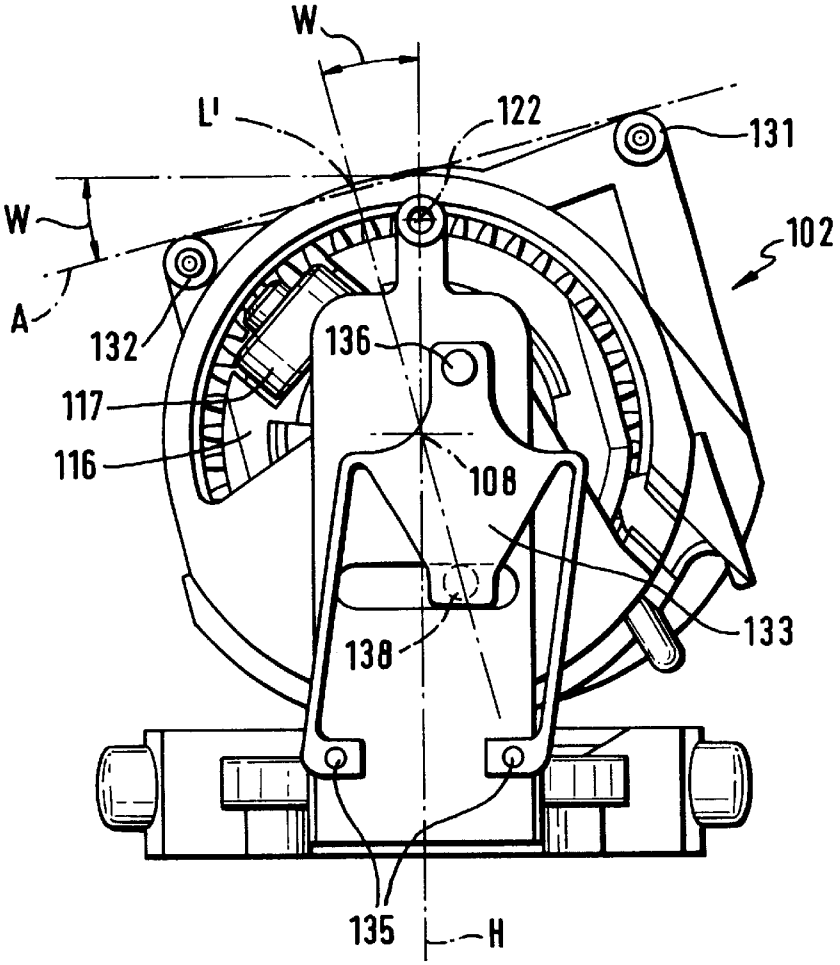
FIGS. 12 and 13 are, respectively, schematic perspective and side views of the epilation appliance of FIG. 8 in a deflected position.
Figure 12:
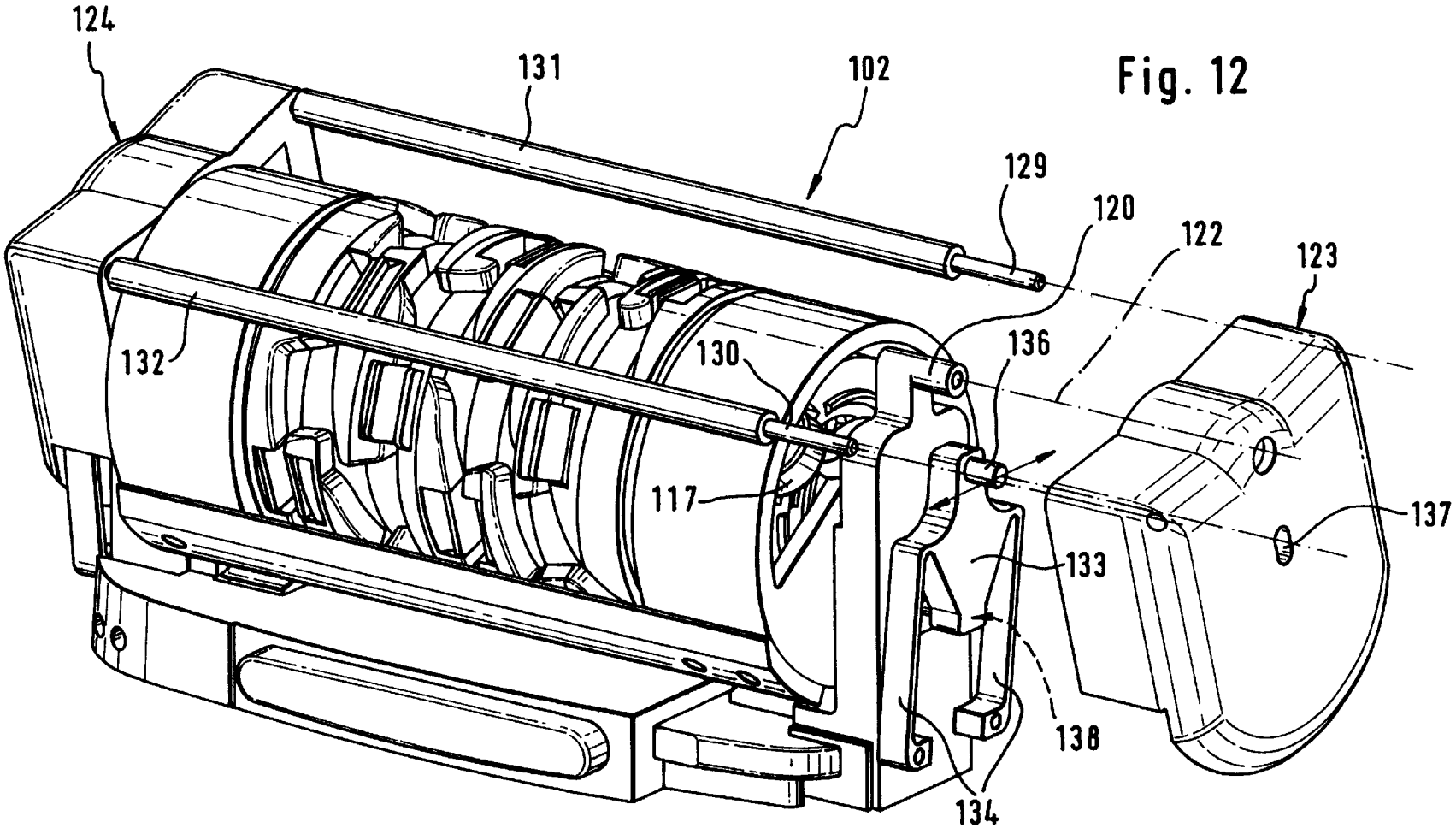

In the deflected position shown in FIGS. 12 and 13, the engaging surface A is at an angle of inclination W transverse to the main plane of extension H. In this condition the side members 123, 124 are also deflected about the pivot axis 122. As a result, also the disks 116 of the rotary cylinder 103 are deflected about the axis of rotation 108 through the pins 136 and 138 and the associated oblong holes 137, 140. Deflection of the disks 116 also entails a corresponding deflection of the pressure elements 117 about the axis of rotation 108. Due to the coinciding relative distances of the pivot axis 122 to the pins 136 and of the pins 138 to the axis of rotation 108, the actuating wheels 117 are deflected through the same angle of inclination W relative to the main plane of extension H as the engaging surface A.

When the user places the epilation appliance 101 in contact with the skin at the said angle of inclination W and hence in accordance with the deflected position of FIGS. 12 and 13, the deflected pressure elements 117 cause the closing movement of the pairs 109 of clamping elements to take place in the area of the line L' with an angular displacement amounting approximately to said angle of inclination W, closing being hence again effected precisely along the line of contact between the rotary cylinder 103 and the user's skin. Hairs present in this area are caught by the pairs 109 of clamping elements and extracted by the rotation of the rotary cylinder 103.

What is claimed is:

1. An epilation appliance for removal of hairs from skin of a human body, comprising a rotary cylinder equipped with clamping elements operable to execute a closing movement within a zone of rotary movement of the rotary cylinder, with a mechanism capable of adjusting the zone of the closing movement in dependence upon an angle at which the epilation appliance is placed against the skin, said mechanism being pivotal about a pivotal axis and wherein the pivot axis of said mechanism is disposed in offset relation to an axis of rotation of the rotary cylinder.

2. The epilation appliance as claimed in claim 1, characterized in that said mechanism includes a sensor which detects the angle at which the epilation appliance is placed against the skin, and that said sensor is pivotal about the pivot axis disposed approximately parallel to the axis of rotation of the rotary cylinder.

3. The epilation appliance as claimed in claim 2, characterized in that said sensor spans an engaging surface by means of which the epilation appliance is placed in contact with the skin.

4. The epilation appliance as claimed in claim 3, characterized in that the pivot axis is arranged on a side of the engaging surface facing away from the axis of rotation of the rotary cylinder or in the engaging surface.

5. The epilation appliance as claimed in claim 3, characterized in that the pivot axis is arranged on a side of the engaging surface where the axis of rotation of the rotary cylinder is located, said axis of rotation being arranged at a small relative distance to said engaging surface.

6. The epilation appliance as claimed in claim 5, characterized in that the sensor includes two bars, rollers, lifting combs or housing edges, which span between them the engaging surface and are arranged approximately parallel to each other and approximately parallel to the axis of rotation of the rotary cylinder.

7. The epilation appliance as claimed in claim 6, characterized in that the sensor includes at least one side member which is pivotally connected to a pin forming the pivot axis and which supports the two bars.

8. The epilation appliance as claimed in claim 7, characterized in that an actuating means is provided by means of which the closing movement of the clamping elements can be produced within the zone, said actuating means being pivotal about the axis of rotation of the rotary cylinder in dependence upon the angle at which the epilation appliance is placed against the skin.

9. The epilation appliance as claimed in claim 8, characterized in that said actuating means includes at least one pressure element and one actuating element providing for adjustment of one of the clamping elements.

10. The epilation appliance as claimed in claim 9, further comprising a transmission means for coupling the sensor with the actuating means.

11. The epilation appliance as claimed in claim 10, characterized in that said transmission means includes a pivotal swinging member which is coupled with the sensor and the actuating means via driving elements.

12. The epilation appliance as claimed in claim 11, characterized in that said swinging member is made of a flexible material.

13. The epilation appliance as claimed in claim 12, characterized in that the transmission means transmits the angle detected by the sensor to the actuating means at a transmission ration of essentially 1:1.

14. The epilation appliance as claimed in claim 12, characterized in that said transmission means includes a pin engaging in an oblong hole of the sensor, and a further pin engaging in an oblong hole of the actuating means.

15. The epilation appliance as claimed in claim 14, characterized in that a relative distance of the pivot axis of the sensor to the pin engaging in the oblong hole of the sensor is approximately equal to a relative distance of the pin engaging in the oblong hole of the actuating means to the axis of rotation of the rotary cylinder.

16. The epilation appliance as claimed in claim 15, characterized in that the zone of the closing movement is adjustable by an angle of up to 60 degrees, approximately.

17. The epilation appliance as claimed in claim 16, characterized in that said epilation appliance has a main plane of extension, that the zone of the closing movement in a home position is arranged approximately in said main plane of extension, and that the zone of the closing movement is deflectable from the main plane of extension by an angle of about 17.5 degrees.

18. The epilation appliance as claimed in claim 1, characterized in that the rotary cylinder and the mechanism for adjusting the zone of the closing movement form an independently handleable unit.

19. The epilation appliance as claimed in claim 18, characterized in that said mechanism comprise at least one actuator which is pivotal about an axis of the rotary cylinder.

20. The epilation appliance as claimed in claim 19, characterized in that said actuator is actuatable in dependence upon the angle at which the epilation appliance is placed against the skin.

21. An epilation appliance for the removal of hairs according to claim 1, characterized in that said mechanism is arranged adjacent to the rotary cylinder, and the clamping elements of the rotary cylinder are engageable with the user's skin.

22. The epilation appliance as claimed in claim 21, characterized in that said mechanism is configured as a correcting means and mounted adjustably relative to the rotary cylinder, with a variation of a position of the correcting means producing a variation of the closing location or closing instant of the clamping elements.

23. The epilation appliance as claimed in claim 22, characterized in that said correcting means is arranged laterally adjacent to the rotary cylinder and is movable across the user's skin essentially in unison with the rotary cylinder.

24. The epilation appliance as claimed in claim 23, characterized in that said correcting means is spring mounted essentially on a supporting structure or a housing accommodating the rotary cylinder.

25. The epilation appliance as claimed in claim 24, characterized in that said correcting means is constructed essentially as a yoke or as a frame having at least one substantially plane, straight-line contact surface for seating engagement with a user's skin.

26. The epilation appliance as claimed in claim 25, characterized in that said correcting means is provided with a roller or a comb arranged essentially parallel to the axis of rotation of the rotary cylinder.

27. The epilation appliance as claimed in claim 26, characterized in that said comb or said roller has at one or both ends thereof a swivel arm which extends along one or both ends of the rotary cylinder and is mounted for pivotal movement relative to the supporting structure.

28. The epilation appliance as claimed in claim 27, characterized in that said correcting means is mounted for pivotal movement essentially about the axis of the rotary cylinder or about another axis disposed essentially parallel to the axis of the rotary cylinder.

29. The epilation appliance as claimed in claim 28, characterized in that an upper and a lower stop are provided for the correcting means.

30. The epilation appliance as claimed in claim 29, characterized in that said correcting means is biased by means of a spring element in such manner that said correcting means, during use, is urged into engagement with the user's skin, springing back into an upper stop position automatically after use.

31. The epilation appliance as claimed in claim 30, characterized in that said at least one swivel arm of said correcting means, is connected to at least one control element in a manner preventing relative rotation, said control element being a thrust plate with a pressure roller, said pressure roller controlling at least one actuating element for actuating the clamping elements.

32. The epilation appliance as claimed in claim 31, characterized in that in a plane substantially normal to the axis of rotation of the rotary cylinder, the axis of rotation of the control element, and the longitudinal axis of the swivel arm are in such relative arrangement that an included angle defined between the closing location of the clamping elements during use and the contact location is essentially constant.

33. The epilation appliance as claimed in claim 32, characterized in that it includes an epilation head which is either integrally formed or detachably connected with the epilation appliance.

34. The epilation appliance as claimed in claim 1 wherein said pivot axis of said mechanism is disposed above the axis of rotation of the rotary cylinder.

* * * * *